US011801525B1

(12) United States Patent
Yoo et al.

(10) Patent No.: US 11,801,525 B1
(45) Date of Patent: Oct. 31, 2023

(54) VEHICLE AXLE GALVANIZING DEVICE

(71) Applicants: Chang Hee Yoo, Daegu (KR); Dong Woog Kim, Daegu (KR)

(72) Inventors: Chang Hee Yoo, Daegu (KR); Dong Woog Kim, Daegu (KR)

(73) Assignee: SANGSIN BRAKE CO., LTD. SANGSIN ENG CO., LTD., Daegu (KR)

( * ) Notice: Subject to any disclaimer, the term of this patent is extended or adjusted under 35 U.S.C. 154(b) by 49 days.

(21) Appl. No.: 17/828,401

(22) Filed: May 31, 2022

(30) Foreign Application Priority Data

May 11, 2022 (KR) ..... 10-2022-0057555

(51) Int. Cl.
*B05C 13/02* (2006.01)
*B05B 13/04* (2006.01)
*B05B 13/02* (2006.01)

(52) U.S. Cl.
CPC ..... *B05B 13/0431* (2013.01); *B05B 13/0228* (2013.01); *B05B 13/0436* (2013.01)

(58) Field of Classification Search
CPC ..... B05B 13/0436
See application file for complete search history.

(56) References Cited

FOREIGN PATENT DOCUMENTS

| | | | |
|---|---|---|---|
| CN | WO2007079770 | * | 7/2007 |
| CN | 106141693 | * | 11/2016 |
| CN | 110116067 | * | 8/2019 |
| CN | 110252560 | * | 9/2019 |

* cited by examiner

*Primary Examiner* — Nathan T Leong
(74) *Attorney, Agent, or Firm* — John K Park; Park Law Firm

(57) ABSTRACT

A vehicle axle galvanizing device is disclosed. A driving clamping unit having a hydraulic chuck installed therein and a driven clamping unit clamp an axle. A dust collection case, configured to accommodate a part to be galvanized of the axle, and cooling cases, configured to accommodate heat-treated bearing joints, are closed. The axle is rotated by a motor in the driving clamping unit, and cold air generated by a cooling unit is continuously sprayed on the heat-treated bearing joints through cooling guns respectively fixed to the cooling cases. Further, in this state, an industrial robot is operated to allow a spray gun in a zinc spray unit to enter the inside of the dust collection case, and zinc melted by the zinc spray unit is sprayed on the part to be galvanized, thereby forming a galvanized layer thereon.

6 Claims, 11 Drawing Sheets

VEHICLE AXLE GALVANIZING DEVICE

BACKGROUND OF THE INVENTION

Field of the Invention

The present invention relates to a vehicle axle galvanizing device configured to form a galvanized layer by spraying zinc on a vehicle axle.

Description of the Related Art

In general, a vehicle is configured to be driven by transmitting driving force generated by an engine to wheels through an axle mounted on a lower portion of a vehicle body. Accordingly, the axle of a vehicle may be exposed to harsh driving environments when the vehicle travels on particular kinds of roads.

More specifically, since a large amount of de-icer is spread on the road in winter, an axle of a truck or a trailer that runs north and south between Canada and the United States is exposed to a corrosive environment caused by calcium chloride, which is used as a de-icer in winter, and an axle of a truck or a trailer travelling on a coastal road is exposed to a corrosive environment caused by the salt of seawater. Accordingly, the axles of trucks or trailers, exposed to such harsh driving environments for a long period of time, must be highly durable to prevent the same from being corroded in the corrosive environment.

Meanwhile, when various iron-containing components such as a vehicle axle are plated with zinc to form a plating layer, zinc is corroded first by reaction with the air in the corrosive environment because zinc has a higher ionization tendency than iron, thereby making it possible to delay corrosion of the corresponding component until a galvanized layer is corroded and iron is exposed to the corrosive environment.

Therefore, a method of galvanizing iron-containing components is disclosed in Patent Document KR 10-1138136, titled "DEVICE AND METHOD OF CONTROLLING SPANGLE OF CONTINUOUS MOLTEN GALVANIZED STEEL SHEET WITH EASY INJECTION POSITION CONTROL" and Patent Document KR 10-1543895, titled "METHOD OF FORMING FUNCTIONAL COATING LAYER ON GALVANIZED STEEL SHEET USING LOW-TEMPERATURE SPRAYING PROCESS AND GALVANIZED STEEL SHEET WITH FUNCTIONAL COATING LAYER".

However, compared to the shape of a steel sheet, a vehicle axle has a complicated three-dimensional shape. Further, bearing joints respectively provided at opposite end portions of the vehicle axle are heat-treated to increase the strength thereof. To this end, a highly specialized apparatus is required in order to protect the heat-treated bearing joints from heat and to form a galvanized layer by spraying high-temperature zinc on the remaining area excluding the area of the bearing joints. Here, since vehicles requiring enhanced axle durability are limited to some trucks and trailers exposed to harsh driving environments for a long period of time, axles of general vehicles are conventionally protected by a paint layer formed by applying general paint, which is vulnerable to changes in temperature and scratching, on the axles thereof regardless of the driving environment. Therefore, in the case of trucks or trailers exposed to harsh driving environments for a long period of time, frequent breakdowns caused by corrosion of the axle occur, which interrupts cargo transportation. In addition, shortening the lifetime of a vehicle due to breakdowns related to an axle of the vehicle may cause significant financial and economic loss.

RELATED ART DOCUMENT

Patent Document (Patent Document 1) KR 10-1138136 "DEVICE AND METHOD OF CONTROLLING SPANGLE OF CONTINUOUS MOLTEN GALVANIZED STEEL SHEET WITH EASY INJECTION POSITION CONTROL"

(Patent Document 2) KR 10-1543895 "METHOD OF FORMING FUNCTIONAL COATING LAYER ON GALVANIZED STEEL SHEET USING LOW-TEMPERATURE SPRAYING PROCESS AND GALVANIZED STEEL SHEET WITH FUNCTIONAL COATING LAYER"

SUMMARY OF THE INVENTION

Therefore, the present invention has been made in view of the above problems, and it is an object of the present invention to provide a vehicle axle galvanizing device configured to protect a heat-treated bearing joint from heat, the heat-treated bearing joint being provided at an axle of a vehicle requiring enhanced durability, such as an axle of a truck or a trailer exposed to harsh driving environments for a long period of time, and to form a galvanized layer by spraying zinc on a part to be galvanized excluding the bearing joint.

In accordance with the present invention, the above and other objects can be accomplished by the provision of a vehicle axle galvanizing device, characterized in that a driving clamping unit having a hydraulic chuck installed therein and a driven clamping unit clamp an axle. A dust collection case, configured to accommodate a part to be galvanized of the axle, and cooling cases, configured to accommodate heat-treated bearing joints, are closed. The axle is rotated by a motor in the driving clamping unit, and cold air generated by a cooling unit is continuously sprayed on the heat-treated bearing joints through cooling guns respectively fixed to the cooling cases. Further, in this state, an industrial robot is operated to allow a spray gun in a zinc spray unit to enter the inside of the dust collection case, and zinc melted by the zinc spray unit is sprayed on the part to be galvanized, thereby forming a galvanized layer thereon.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described for illustrative purposes. The following embodiments are provided for easier understanding of the present invention, and the contents of the present invention are not limited to the embodiments described in the specification.

Figure 1:
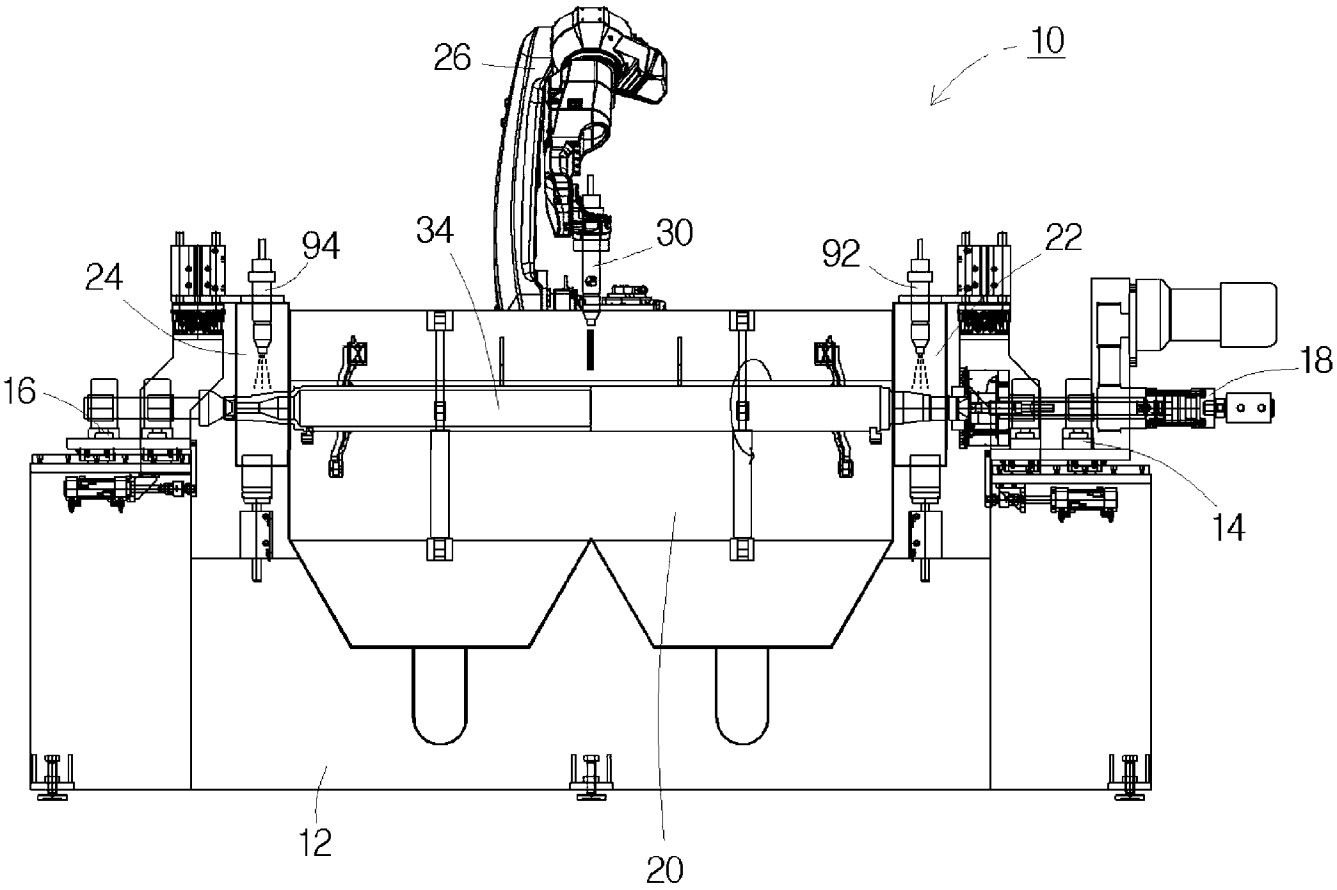
FIG. 1 is a front view of the present invention.
Figure 2:
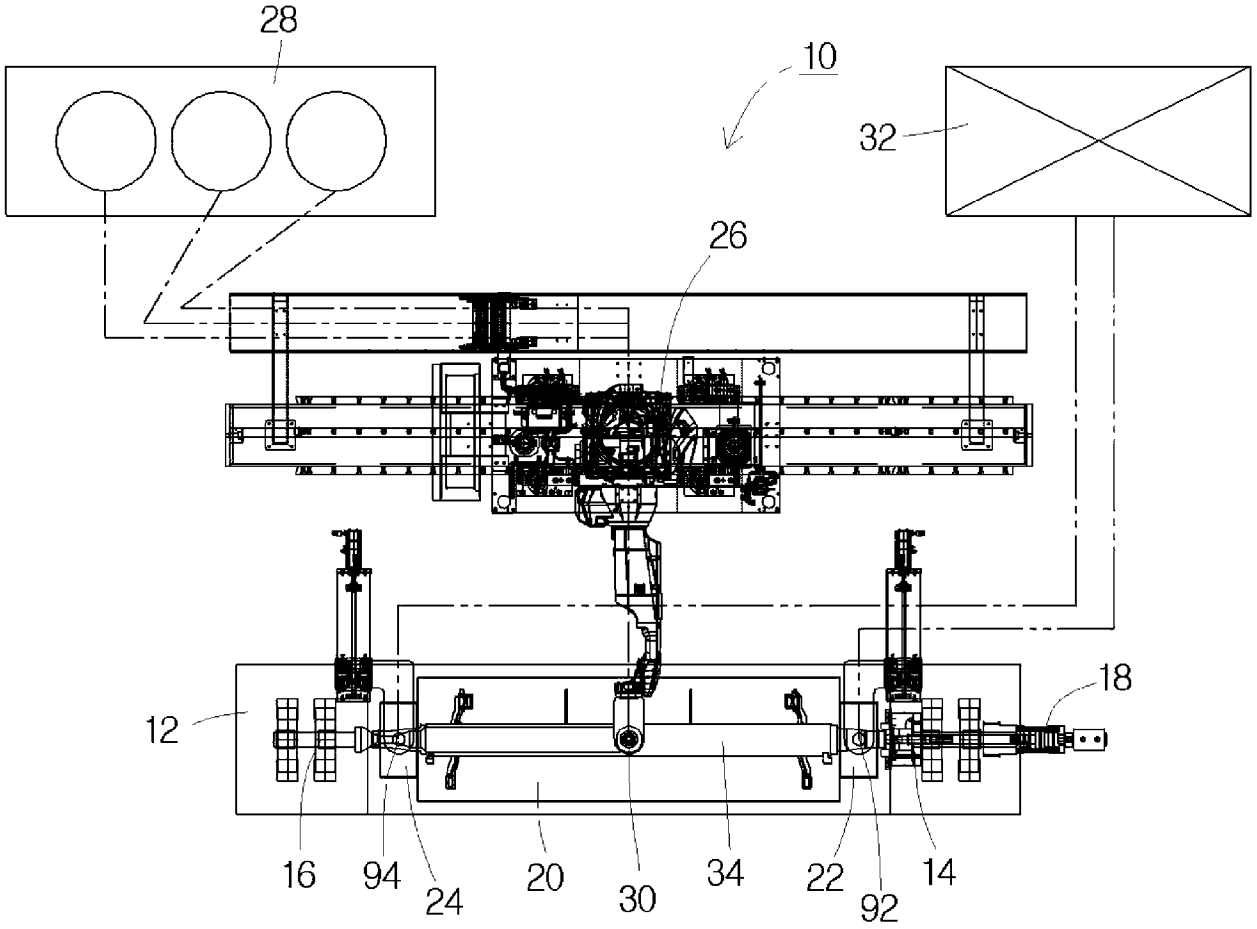
FIG. 2 is a plan view of the present invention.
Figure 3:
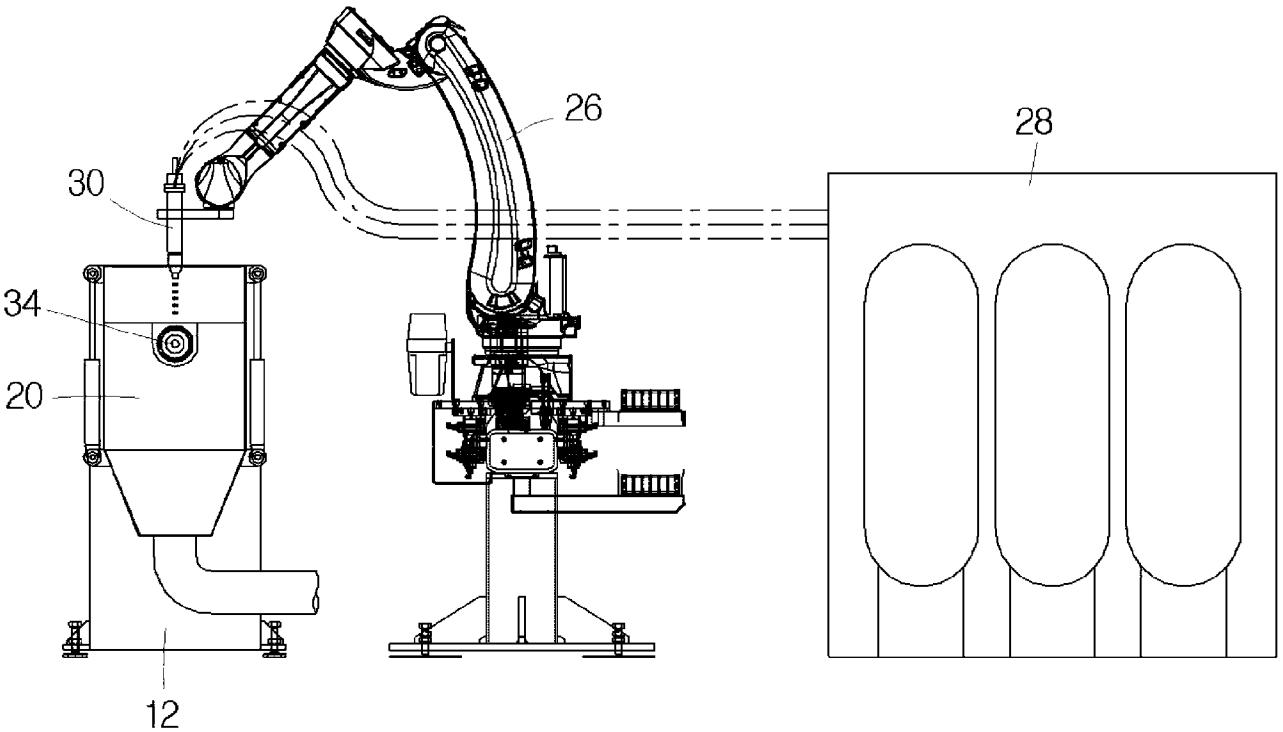
FIG. 3 is a side view showing a galvanizing unit of the present invention.
Figure 4:
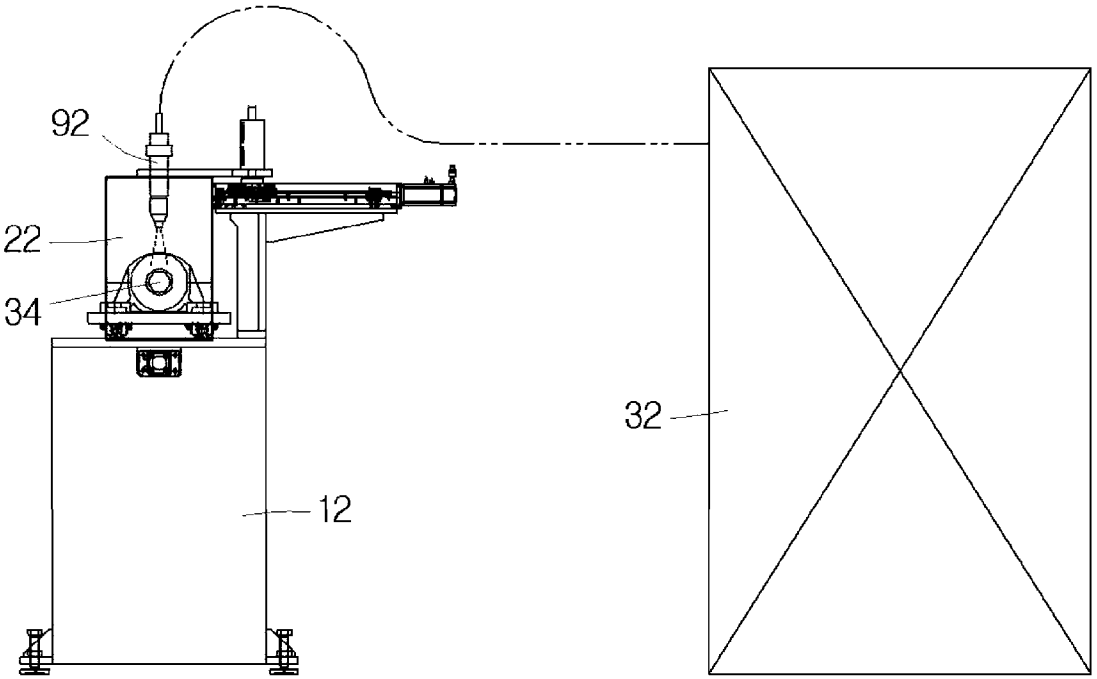
FIG. 4 is a side view showing a cooling unit of the present invention.

FIG. 1 is a front view of the present invention, FIG. 2 is a plan view of the present invention, FIG. 3 is a side view showing a galvanizing unit of the present invention, and FIG. 4 is a side view showing a cooling unit of the present invention. In a vehicle axle galvanizing device 10 of the present invention, a driving clamping unit 14 and a driven clamping unit 16 are connected to and installed on opposite sides of a support frame 12, respectively, so that the driving clamping unit 14 and the driven clamping unit 16 face each other. A hydraulic chuck 18 is installed in the driving clamping unit 14. A dust collection case 20, which is connected to a dust collector, is fixedly installed between the driving clamping unit 14 and the driven clamping unit 16. Cooling cases 22 and 24, respectively formed on the left side and the right side of the dust collection case 20 with the dust collection case 20 interposed therebetween, are also fixedly installed between the driving clamping unit 14 and the driven clamping unit 16. An industrial robot 26 is installed behind the dust collection case 20. A zinc spray unit 28 is installed near the industrial robot 26 to fixedly connect a spray gun 30 in the zinc spray unit 28 to the arm of the industrial robot 26. Further, after a cooling unit 32 is installed near the cooling cases 22 and 24, an axle 34 is clamped between the driving clamping unit 14 and the driven clamping unit 16. Next, zinc is sprayed on a part to be galvanized 40 while heat-treated bearing joints 36 and 38 are continuously cooled, thereby forming a galvanized layer.

Figure 5:
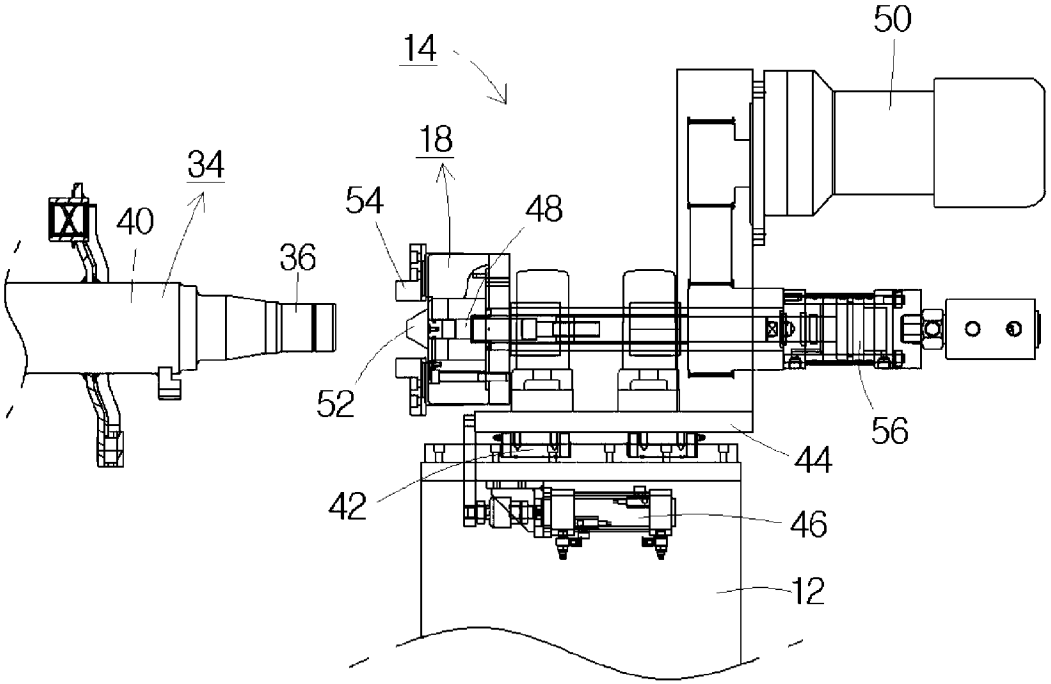
FIG. 5 is a front view showing a driving clamping unit and a hydraulic chuck used in the present invention.

FIG. 5 is a front view showing the driving clamping unit and the hydraulic chuck used in the present invention. The driving clamping unit 14 includes a moving body 44 connected to and installed in the support frame 12 by an LM guide 42, a horizontal cylinder 46 configured to connect the support frame 12 to the moving body 44 and installed therebetween to horizontally operate the moving body 44, a drive shaft 48 connected to and installed in the moving body 44 to rotate with respect to the moving body 44, a motor 50 fixedly installed in the moving body 44 and connected to the drive shaft 48, and a tapered clamping part 52 fixedly connected to the inner end of the drive shaft 48.

The hydraulic chuck 18 installed in the driving clamping unit 14 includes a chuck part 54 connected thereto and installed therein so as to be located near the clamping part 52 of the driving clamping unit 14, and a hydraulic cylinder 56 fixedly installed on the outside of the moving body 44 and connected to the chuck part 54. Here, the chuck part 54 is configured to hold one end of the axle 34 clamped to the driving clamping unit 14.

Meanwhile, in the present invention, the hydraulic chuck 18 is installed in the driving clamping unit 14, but a pneumatic chuck or a manual chuck may be installed therein instead of the hydraulic chuck 18. In addition, after the axle 34 is clamped by the driving clamping unit 14 and the driven clamping unit 16, it is also possible to use any type of fixing unit capable of firmly connecting and fixing the axle 34 to the drive shaft 48 of the motor 50.

Figure 6:
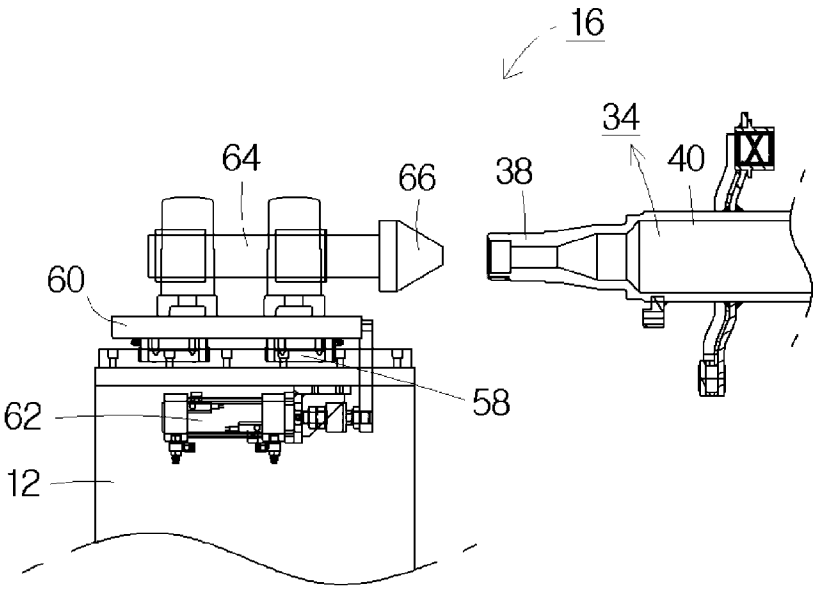
FIG. 6 is a front view showing a driven clamping unit used in the present invention.

FIG. 6 is a front view showing the driven clamping unit used in the present invention. The driven clamping unit 16 includes a moving body 60 connected to and installed in the support frame 12 by an LM guide 58, a horizontal cylinder 62 configured to connect the support frame 12 to the moving body 60 and installed therebetween to horizontally operate the moving body 60, a driven shaft 64 connected to and installed in the moving body 60 to idle with respect to the same, and a tapered clamping part 66 fixedly connected to the inner end of the driven shaft 64.

Figure 7:
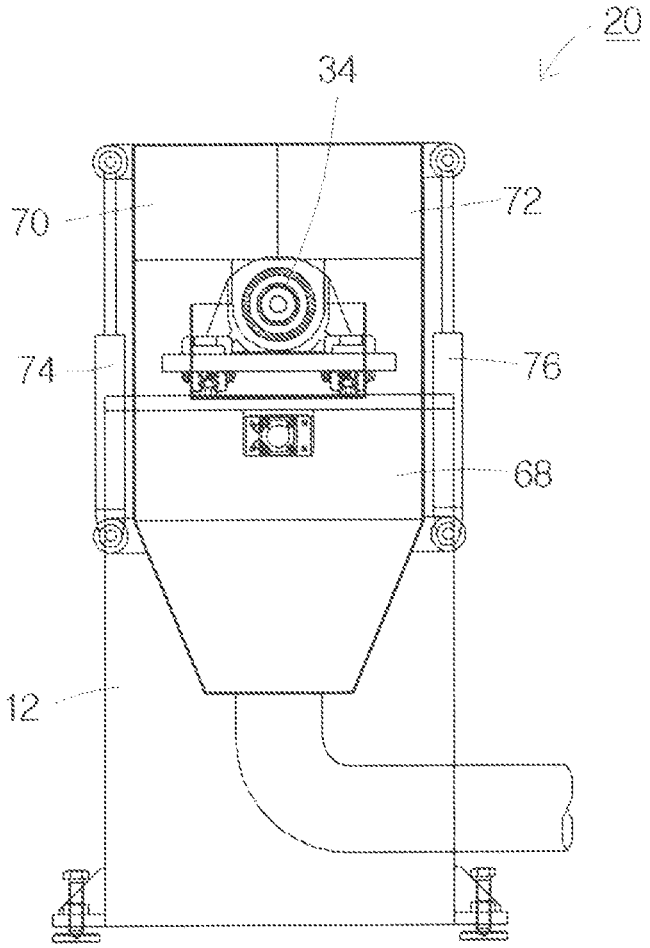
FIG. 7 is a side view showing a dust collection case used in the present invention when the same is closed.
Figure 8:
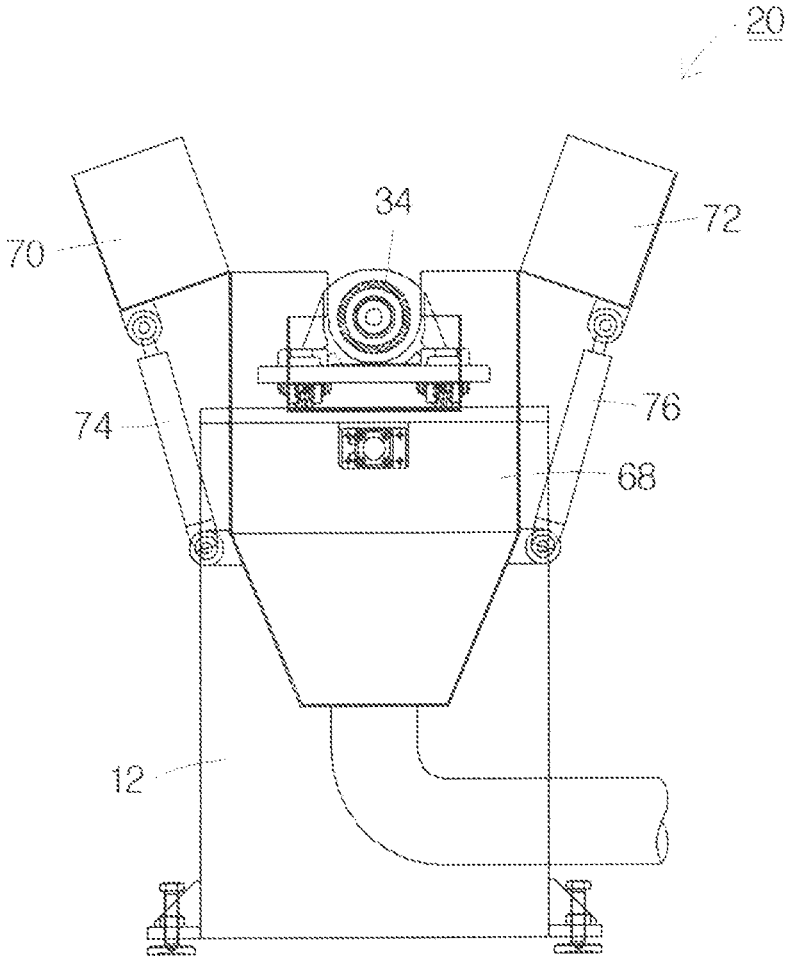
FIG. 8 is a side view showing the dust collection case used in the present invention when the same is opened.

FIG. 7 is a side view showing the dust collection case used in the present invention when the same is closed, and FIG. 8 is a side view showing the dust collection case used in the present invention when the same is opened. The dust collection case 20, which is fixedly installed between the driving clamping unit 14 and the driven clamping unit 16 and is connected to the dust collector, includes a main body part 68 fixedly installed in the support frame 12 and configured to accommodate the part to be galvanized 40 of the axle 34 clamped by the driving clamping unit 14 and the driven clamping unit 16, opening and closing parts 70 and 72 installed to connect the front and rear of an upper portion of the main body 68, the upper portion of the main body 68 having an entry groove formed therein, the entry groove having side surfaces thereof facing each other in the longitudinal direction thereof, and operation cylinders 74 and 76 installed to connect the main body part 68 to the opening and closing parts 70 and 72 and configured to open and close the opening and closing parts 70 and 72.

The dust collector connected to the dust collection case 20 is generally used to collect waste zinc scattered in the dust collection case 20 when the spray gun 30 in the zinc spray unit 28 sprays zinc on the part to be galvanized 40 of the axle 34, and further detailed description thereof will be omitted.

Figure 9:
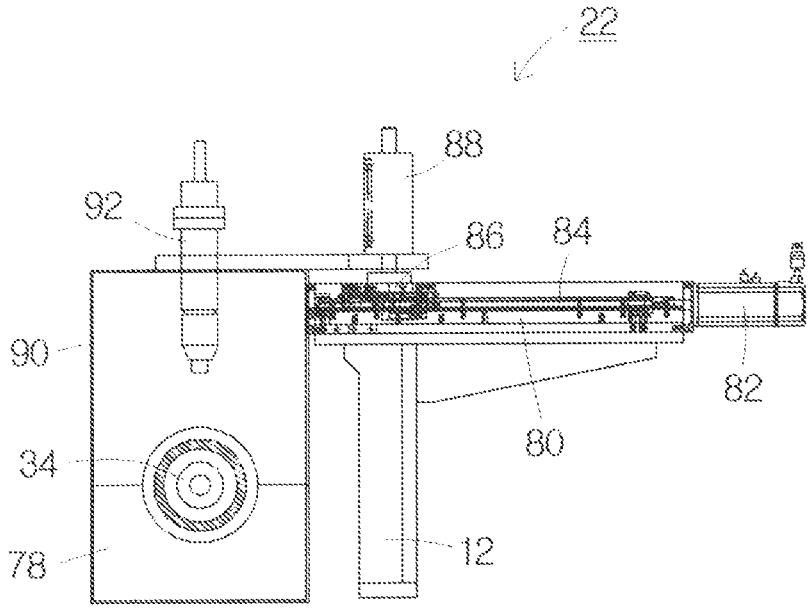
FIG. 9 is a side view showing a cooling case used in the present invention when the same is closed.
Figure 10:
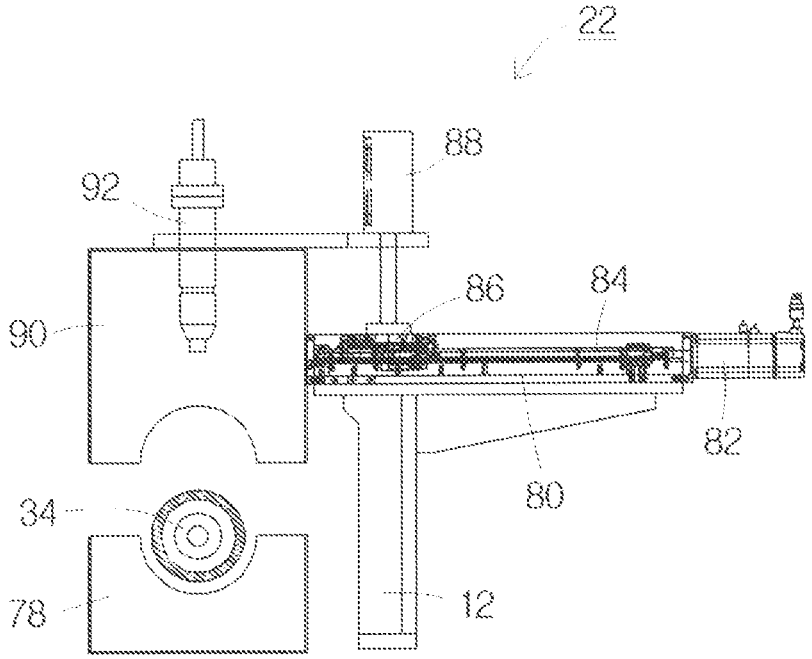
FIG. 10 is a side view showing the cooling case used in the present invention when the same is being opened.
Figure 11:
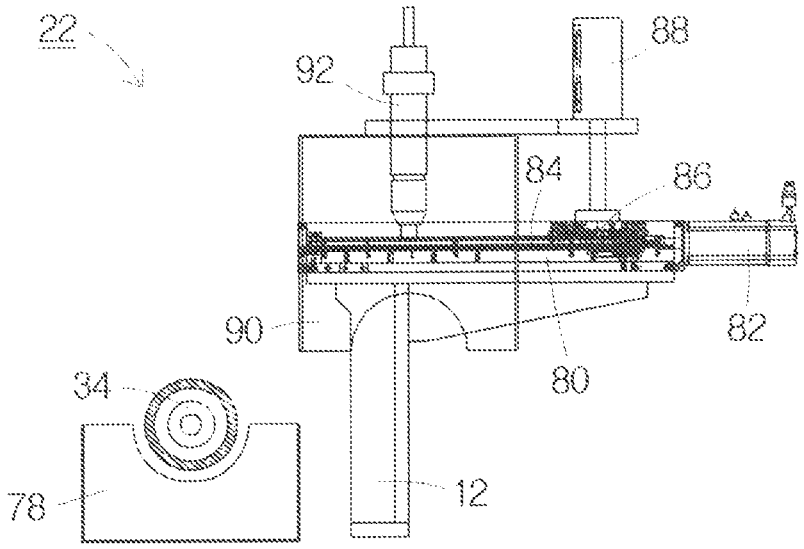
FIG. 11 is a side view showing the cooling case used in the present invention when the same is opened.

FIG. 9 is a side view showing the cooling case used in the present invention when the same is closed, FIG. 10 is a side view showing the cooling case used in the present invention when the same is being opened, and FIG. 11 is a side view showing the cooling case used in the present invention when the same is opened. Each of the cooling cases 22 and 24, respectively formed on the left side and the right side of the dust collection case 20 with the dust collection case 20 interposed therebetween, includes a main body part 78 fixedly installed in the support frame 12 and configured to accommodate each of the heat-treated bearing joints 36 and 38 of the axle 34 clamped by the driving clamping unit 14 and the driven clamping unit 16, a moving body 86 connected to and installed in the support frame 12 by an LM guide 80 so as to be located on the rear side of the main body part 78 and configured to be operated horizontally by a ball screw 84 connected to a motor 82, and an opening and closing part 90 connected to the moving body 86 by a vertical cylinder 88 and configured to open and close the main body part 78.

The industrial robot 26 installed behind the dust collection case 20 is formed of a base, a revolving frame connected to the base, a lower arm connected to the revolving frame, and an upper arm connected to the lower arm. Here, the spray gun 30 provided in the zinc spray unit 28 is fixedly connected to the upper arm thereof, and a controller performs a control operation to allow the spray gun 30 to enter the inside of the dust collection case 20 to spray zinc on the part to be galvanized 40 of the axle 34 and form a galvanized layer.

The zinc spray unit 28 installed near the industrial robot 26 is generally formed of a zinc powder tank, a gas tank, an air supply unit, and the spray gun 30 connected thereto by a hose. Here, zinc is sprayed on the part to be galvanized 40 of the axle 34 using the spray gun 30 in the state in which zinc powder is melted by high heat generated during gas combustion, thereby performing galvanization on the part to be galvanized 40 of the axle 34.

The cooling unit 32, installed near the cooling cases 22 and 24, includes a cooling unit including a compressor, a condenser, an expansion valve, and an evaporator, a high-pressure transport unit configured to transport cold air cooled by the cooling unit at high pressure, and cooling guns 92 and 94, each of which is fixedly installed in a corresponding one of the opening and closing parts 90 of the cooling cases 22 and 24, the cooling guns 92 and 94 respectively spraying cold air generated by the cooling unit on the heat-treated bearing joints 36 and 38 of the axle 34 at high pressure.

The process of galvanizing the axle 34 according to the present invention will be described below. The opening and closing parts 70 and 72 of the dust collection case 20 are opened by operation of the operation cylinders 74 and 76, and the opening and closing parts 90 of the cooling cases 22 and 24 are opened by operation of the motor 82 and the vertical cylinder 88. In this state, after the axle 34 is placed in the space between the driving clamping unit 14 and the driven clamping unit 16 by an operator or a separate automatic supply unit, the driving clamping unit 14 and the driven clamping unit 16 move forwards by operation of the horizontal cylinders 46 and 62 to clamp the axle 34. Next, the chuck part 54 of the hydraulic chuck 18 in the driving clamping unit 14 holds the axle 34 by operation of the hydraulic chuck 18 installed in the driving clamping unit 14.

Further, after the driving clamping unit 14 and the driven clamping unit 16 clamp the axle 34, the opening and closing parts 70 and 72 of the dust collection case 20 and the opening and closing parts 90 of the cooling cases 22 and 24 are closed, and the axle 34 is rotated by driving the motor 50 provided in the driving clamping unit 14. Next, the cooling unit 32 is operated so that cold air generated by the cooling unit 32 is sprayed on the bearing joints 36 and 38 of the axle 34 through the cooling guns 92 and 94 respectively fixed to the cooling cases 22 and 24. Further, in the state in which the heat-treated bearing joints 36 and 38 are constantly cooled, the industrial robot 26 is operated to allow the spray gun 30 in the zinc spray unit 28 fixedly connected to the arm of the industrial robot 26 to enter the inside of the dust collection case 20 through the entry groove formed between the opening and closing parts 70 and 72 of the dust collection case 20. Next, the spray gun 30 is operated to face the part to be galvanized 40 of the axle 34 and the zinc spray unit 28 is operated to spray zinc on the part to be galvanized 40 of the axle 34, thereby performing galvanization on the part to be galvanized 40 and forming a galvanized layer thereon.

After the part to be galvanized 40 of the axle 34 is galvanized, the zinc spray unit 28 and the cooling unit 32 stop the operation thereof, and the opening and closing parts 70 and 72 of the dust collection case 20 and the opening and closing parts 90 of the cooling cases 22 and 24 are opened. Next, the driving clamping unit 14 and the driven clamping unit 16 are unclamped in the state in which the hydraulic chuck 18 installed in the driving clamping unit 14 is released, and the galvanized axle 34 is pulled out. In this manner, the galvanized axle 34 is manufactured by repeatedly performing the above-described operation.

As described in detail above, according to the present invention, it is possible to form a galvanized layer by spraying zinc on the part to be galvanized 40 excluding the bearing joints 36 and 38 while preventing annealing of the heat-treated bearing joints 36 and 38 of the axle 34.

As is apparent from the above description, according to the present invention, the heat-treated bearing joints 36 and 38 of the vehicle axle 34 can be protected from heat to prevent annealing thereof, and a galvanized layer can be formed by spraying zinc on the part to be galvanized 40. Accordingly, in the case of trucks or trailers exposed to harsh driving environments for a long period of time, there is no risk of interruption of cargo transportation due to breakdowns related to corrosion of the axle 34. In addition, there is no risk of shortening of the lifetime of a vehicle due to breakdowns related to the axle 34, thereby having an effect of preventing significant financial and economic loss.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vehicle axle galvanizing device comprising:

a support frame;

a driving clamping unit connected to and installed on one side of the support frame;

a driven clamping unit connected to and installed on the other side of the support frame so as to face the driving clamping unit;

a dust collection case installed between the driving clamping unit and the driven clamping unit;

two cooling cases respectively formed on a left side and a right side of the dust collection case with the dust collection case interposed therebetween, the two cooling cases being installed between the driving clamping unit and the driven clamping unit;

an industrial robot installed behind the dust collection case;

a zinc spray unit installed near the industrial robot and configured to fixedly connect a spray gun provided therein to an arm of the industrial robot; and a cooling unit installed near each of the cooling cases and configured to fixedly install a cooling gun thereof in each of the cooling cases.

2. The vehicle axle galvanizing device according to claim 1, wherein the driving clamping unit comprises:

a moving body connected to the support frame by an LM guide, a horizontal cylinder configured to connect the support frame to the moving body and installed therebetween to horizontally operate the moving body, a drive shaft connected to and installed in the moving body to rotate with respect to the moving body, a motor fixedly installed in the moving body and connected to the drive shaft, and a clamping part fixedly connected to the drive shaft.

3. The vehicle axle galvanizing device according to claim 1, wherein the driven clamping unit comprises:

a moving body connected to the support frame by an LM guide, a horizontal cylinder configured to connect the support frame to the moving body and installed therebetween to horizontally operate the moving body, a driven shaft connected to and installed in the moving body to idle with respect to the moving body, and a clamping part fixedly connected to the driven shaft.

4. The vehicle axle galvanizing device according to claim 2, wherein the driving clamping unit comprises a hydraulic chuck installed therein, the hydraulic chuck comprising a chuck part connected thereto and installed therein so as to be located near the clamping part of the driving clamping unit and a hydraulic cylinder fixedly installed on an outside of the moving body and connected to the chuck part, the chuck part being configured to hold one end of an axle clamped to the driving clamping unit.

5. The vehicle axle galvanizing device according to claim 1, wherein the dust collection case comprises:

a main body part fixedly installed in the support frame and configured to accommodate a part to be galvanized of an axle clamped by the driving clamping unit and the driven clamping unit, opening and closing parts connected to and installed in an upper portion of the main body, the upper portion of the main body having an entry groove formed in a longitudinal direction thereof, and operation cylinders, each of which is installed to connect the main body part to a corresponding one of the opening and closing parts, the operation cylinders being configured to open and close the opening and closing parts.

6. The vehicle axle galvanizing device according to claim 1, wherein the cooling case comprises:

a main body part fixedly installed in the support frame and configured to accommodate a bearing joint of an axle clamped by the driving clamping unit and the driven clamping unit, a moving body connected to and installed in the support frame by an LM guide and configured to be operated horizontally by a ball screw connected to a motor, and an opening and closing part connected to the moving body by a vertical cylinder and configured to open and close the main body part.

* * * * *